US012016404B2

(12) United States Patent
Hutsenpiller

(10) Patent No.: US 12,016,404 B2
(45) Date of Patent: Jun. 25, 2024

(54) WETNESS INDICATOR TEXTILE

(71) Applicant: NIKE, Inc., Beaverton, OR (US)

(72) Inventor: Scott K. Hutsenpiller, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/171,116

(22) Filed: Feb. 9, 2021

(65) Prior Publication Data

US 2021/0161219 A1 Jun. 3, 2021

Related U.S. Application Data

(63) Continuation of application No. 16/156,574, filed on Oct. 10, 2018, now Pat. No. 10,993,484.
(Continued)

(51) Int. Cl.
*A41D 27/14* (2006.01)
*A41D 1/06* (2006.01)
(Continued)

(52) U.S. Cl.
CPC ..... *A41D 1/06* (2013.01); *A41D 1/08* (2013.01); *A41D 1/085* (2018.01);
(Continued)

(58) Field of Classification Search
CPC .. D06N 7/0092; D06N 7/0006; D06N 7/0036; D06N 2209/126–128; D06M 2200/10; D06M 2200/12; B32B 3/10; B41M 5/0029; B44F 1/10; B44F 3/00; B44F 99/00; Y10T 428/24835
(Continued)

(56) References Cited

U.S. PATENT DOCUMENTS 2,075,945 A 4/1937 Hurt
4,231,370 A 11/1980 Mroz et al.
(Continued)

FOREIGN PATENT DOCUMENTS

CA 2849772 C 11/2014
CN 1988868 A 6/2007
(Continued)

OTHER PUBLICATIONS

Office Action received for European Patent Application No. 18797429.0, dated Apr. 26, 2021, 4 pages.
(Continued)

*Primary Examiner* — Larissa Rowe Emrich
(74) *Attorney, Agent, or Firm* — Shook, Hardy & Bacon L.L.P.

(57) ABSTRACT

The technology described herein relates to a pair of long pants garment panel comprising a pattern of a durable water-repellant (DWR) coating that is selectively applied on to the pant legs of the pair of long pants. The pattern is comprised of a plurality of discrete shapes that are isolated from one another. In other words, the textile material surrounding each discrete shape in the plurality of discrete shapes is not coated by the DWR coating. A size of the plurality of discrete shapes in the pattern is gradually decreased moving up the pant legs starting from a hemmed edge up to a knee area. The pattern is visible during wet conditions and not visible during dry conditions.

19 Claims, 6 Drawing Sheets

Related U.S. Application Data

(60) Provisional application No. 62/573,863, filed on Oct. 18, 2017.

(51) Int. Cl.

| | |
|---|---|
| ***A41D 1/08*** | (2018.01) |
| ***A41D 1/085*** | (2018.01) |
| ***A41D 13/00*** | (2006.01) |
| ***A41D 31/02*** | (2019.01) |
| ***D06N 3/00*** | (2006.01) |
| *A41D 31/12* | (2019.01) |

(52) U.S. Cl.
CPC ..... *A41D 13/0002* (2013.01); *A41D 13/0015* (2013.01); *A41D 27/145* (2013.01); *A41D 31/02* (2013.01); *D06N 3/0006* (2013.01); *D06N 3/0036* (2013.01); *A41D 31/12* (2019.02); *A41D 2500/20* (2013.01); *A41D 2500/54* (2013.01); *D06N 2209/126* (2013.01); *D06N 2211/10* (2013.01); *D06N 2213/045* (2013.01)

(58) Field of Classification Search
USPC ..... 428/199
See application file for complete search history.

(56) References Cited

U.S. PATENT DOCUMENTS

| | | | | |
|---|---|---|---|---|
| 4,265,954 | A | 5/1981 | Romanek | |
| 5,112,666 | A | 5/1992 | Langston | |
| 5,435,010 | A | 7/1995 | May | |
| 5,466,515 | A | 11/1995 | Blauer et al. | |
| 5,990,377 | A | 11/1999 | Chen et al. | |
| 6,235,659 | B1 | 5/2001 | McAmish et al. | |
| 6,572,575 | B1 | 6/2003 | Shimada et al. | |
| 6,774,065 | B2 | 8/2004 | Haruta et al. | |
| 7,056,570 | B2 | 6/2006 | Nakashima et al. | |
| 7,344,619 | B2 | 3/2008 | Helmeke | |
| 7,682,994 | B2 | 3/2010 | Van et al. | |
| 7,754,626 | B2 | 7/2010 | Baron et al. | |
| 8,176,569 | B2 | 5/2012 | Rock et al. | |
| 8,806,663 | B2 | 8/2014 | White et al. | |
| 8,845,230 | B2 * | 9/2014 | Drago | D06P 1/004 40/594 |
| 8,905,275 | B1 | 12/2014 | Klein | |
| 8,906,275 | B2 | 12/2014 | Davis et al. | |
| 8,945,100 | B2 | 2/2015 | Rogers | |
| 8,946,100 | B2 | 2/2015 | Dutkiewicz et al. | |
| 9,006,117 | B2 | 4/2015 | Johnson et al. | |
| 9,017,505 | B2 | 4/2015 | Gallagher | |
| 10,993,484 | B2 | 5/2021 | Hutsenpiller | |
| 2004/0117923 | A1 | 6/2004 | Taylor et al. | |
| 2004/0237164 | A1 | 12/2004 | Aperfine et al. | |
| 2005/0101209 | A1 | 5/2005 | Li et al. | |
| 2006/0143772 | A1 | 7/2006 | Feduzi et al. | |
| 2006/0160453 | A1 | 7/2006 | Suh | |
| 2006/0179539 | A1 | 8/2006 | Harber | |
| 2007/0022510 | A1 | 2/2007 | Chapuis et al. | |
| 2009/0276936 | A1 | 11/2009 | Makida et al. | |
| 2010/0199406 | A1 | 8/2010 | Dua et al. | |
| 2010/0262099 | A1 | 10/2010 | Klofta | |
| 2012/0122361 | A1 | 5/2012 | Hand et al. | |
| 2012/0317694 | A1 | 12/2012 | Block et al. | |
| 2014/0082815 | A1 | 3/2014 | Harber et al. | |
| 2015/0223533 | A1 * | 8/2015 | Blakely | D06M 11/44 428/196 |
| 2015/0237948 | A1 | 8/2015 | Mallen et al. | |
| 2015/0296890 | A1 | 10/2015 | Moloney | |
| 2016/0075101 | A1 | 3/2016 | Blackford et al. | |
| 2016/0331055 | A1 | 11/2016 | Pezzimenti | |
| 2016/0338435 | A1 | 11/2016 | Aihara | |
| 2017/0035128 | A1 | 2/2017 | Baron et al. | |
| 2017/0058451 | A1 | 3/2017 | Smith et al. | |
| 2019/0110526 | A1 | 4/2019 | Hutsenpiller | |
| 2019/0234013 | A1 | 8/2019 | Xing et al. | |

FOREIGN PATENT DOCUMENTS

| | | | | |
|---|---|---|---|---|
| CN | 201323880 | Y | 10/2009 | |
| CN | 201409492 | Y | 2/2010 | |
| CN | 201509671 | U | 6/2010 | |
| CN | 202552205 | U | 11/2012 | |
| CN | 202618596 | U | 12/2012 | |
| CN | 103628646 | A | 3/2014 | |
| CN | 203851838 | U | 10/2014 | |
| CN | 104664857 | A | 6/2015 | |
| CN | 204426766 | U | 7/2015 | |
| CN | 204861260 | U | 12/2015 | |
| CN | 205006147 | U | 2/2016 | |
| EP | 1254985 | B1 | 2/2007 | |
| JP | H02104782 | A | 4/1990 | |
| JP | 03-195763 | A | 8/1991 | |
| JP | 2004293016 | A | 10/2004 | |
| JP | 2006-207052 | A | 8/2006 | |
| JP | 3195763 | B2 | 1/2015 | |
| WO | 2006100279 | A1 | 9/2006 | |
| WO | WO-2013044108 | A1 * | 3/2013 | A41D 13/005 |
| WO | 2014/205104 | A1 | 12/2014 | |

OTHER PUBLICATIONS

Intention to Grant received for European Patent Application No. 18797429.0, dated Nov. 30, 2022, 6 pages.

Non-Final Office Action received for U.S. Appl. No. 16/156,805, dated Nov. 7, 2022, 10 pages.

1 Final Office Action received for U.S. Appl. No. 16/156,805, dated Jun. 11, 2021, 11 pages.

Final Office Action received for U.S. Appl. No. 16/156,805, dated Jul. 14, 2022, 9 pages.

Summons to Attend Oral Proceedings Office action received for European Patent Application No. 18797429.0, mailed on Aug. 9, 2022, 5 pages.

Non-Final Office Action received for U.S. Appl. No. 16/156,805, dated Aug. 31, 2021, 9 pages.

Office Action received for European Patent Application No. 18807818.2, dated May 9, 2022, 5 pages.

10X® Lock Down Pant with Scentrex®, Walls, Outdoor Goods, Available online at: <http://www.walls.com/new-arrivals/10x-lock-down-pant-with-scentrex/ZP714.html>, Accessed on Apr. 1, 2017, 4 pages.

DWR—Durable Water Repellent, NOMAD, Available online at: <http://nomadoutdoor.com/collections/dwr>, Accessed on Apr. 1, 2017, 2 pages.

Bixler, Gregoryd. , "Bioinspired Surface for Low Drag, Self-Cleaning, and Antifouling: Shark Skin, Butterfty and Rice Leaf Effects", Dissertation Presented in Partial Fulfillment of the Requirements for the Degree Doctor of Philosophy in the Graduate School of the Ohio State University: Mechanical Engineering, 2013, 261 pages.

Koch et al., "Superhydrophobic and superhydrophilic plant surfaces: an inspiration for Biomimetic materials", Philosophical Transactions of the Royal Society of London A, Mathematical, Physical and Engineering Sciences, Available online at:<http://rsta.royalsocietypublishing.org/content/367/1893/1487>, Mar. 15, 2009, 19 pages.

Lomax, G.R. , "The Design of Waterproof, Water Vapour-Permeable Fabrics", Journal of Coated Fabrics, Accessed online at:<https://journals.sagepub.com/doi/10.1177/152808378501500105>, Jul. 1, 1985, 5 pages.

Martines et al., "Superhydrophobicity and Superhydrophilicity of Regular Nanopatterns", Nano Letters, vol. 5, No. 10,, 2005, pp. 2097-2103.

Xing et al., "Interfacial Microfluidic Transport on Micropatterned Superhydrophobic Textile", Lab on a Chip, vol. 13, No. 10, Available online at: <https://www.ncbi.nlm.nih.gov/pubmed/23536189>, May 21, 2013, pp. 1937-1947.

(56) References Cited

OTHER PUBLICATIONS

Office Action received for European Patent Application No. 18797429.0, dated Nov. 19, 2021, 4 pages.
Extended European Search Report received for European Patent Application No. 23169525.5, dated Jul. 3, 2023, 8 pages.
Intention to Grant received for European Patent Application No. 18807818.2, dated Mar. 15, 2023, 7 pages.

* cited by examiner

WETNESS INDICATOR TEXTILE

CROSS-REFERENCE TO RELATED APPLICATIONS

This U.S. patent application Ser. No. 17/171,116, filed on Feb. 9, 2021, and entitled "Wetness Indicator Textile," is a Continuation Application of U.S. patent application Ser. No. 16/156,574, filed on Oct. 10, 2018, and entitled "Wetness Indicator Garment," now issued as U.S. Pat. No. 10,993,484, issued on May 5, 2021, which in turn claims the benefit of priority of U.S. Provisional Application No. 62/573,863, filed on Oct. 18, 2017, and entitled "Wetness Indicator Garment." The entireties of the aforementioned applications are incorporated by reference herein.

STATEMENT REGARDING FEDERALLY SPONSORED RESEARCH OR DEVELOPMENT

Not applicable.

TECHNICAL FIELD

Aspects of the technology described herein relate to a moisture indicator lower body garment.

BACKGROUND

A wearer of, for example, a full length lower body garment may not always be aware of the amount of moisture present in, for example, a grass field. By the time he/she is done walking through the field, the lower body garment may become heavy and uncomfortable close to the bottom edge portion of the lower body garment due to the absorption of large amounts of moisture. Garments in accordance with aspects herein remedy the shortcomings of conventional garments by providing moisture protection as well as a wetness visual indicator that signals the wearer and others in proximity to the wearer, that there is moisture present on the ground.

BRIEF DESCRIPTION OF THE SEVERAL VIEWS OF THE DRAWINGS

The technology described herein is described in detail below with reference to the attached drawing figures, wherein.

DETAILED DESCRIPTION

Figure 1A:
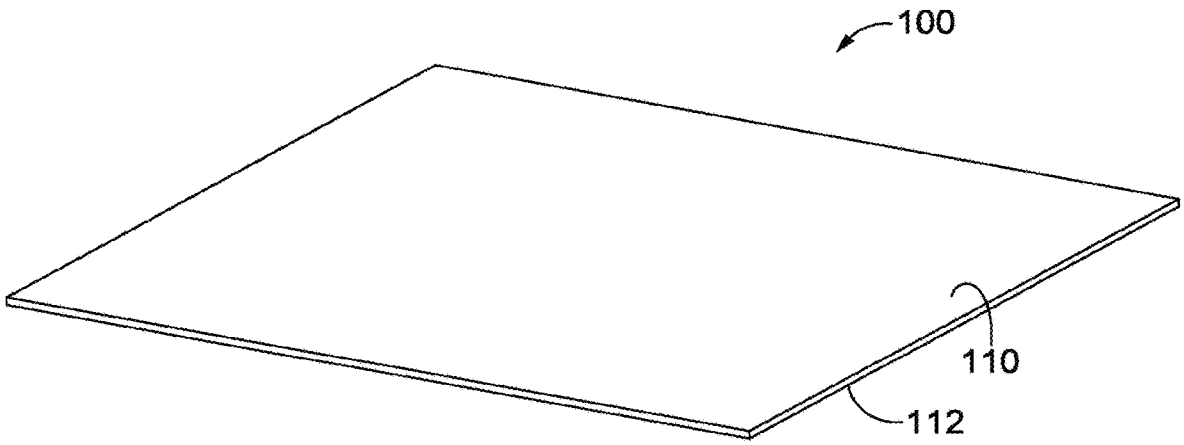
FIG. 1A depicts a fabric or textile panel under dry conditions in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

The technology described herein is generally directed to a wetness indicator fabric or textile and more specifically, to a garment comprised of the wetness indicator fabric or textile. The fabric or textile may be produced by a weaving or a knitting process or may comprise a non-woven material. The wetness indicator fabric or textile generally may comprise a first surface and a second surface opposite the first surface. Depending on which of the first surface or the second surface is configured to be exposed to an external environment, the exposed surface is provided with a water-repellant coating material applied in a pattern on at least a portion of the wetness indicator fabric or textile. The pattern of the water-repellant coating material applied on the fabric or textile is generally not visible when the fabric or textile is dry and only becomes visible when the fabric or textile material becomes wet.

The technology described herein further relates to a lower body garment and more specifically, a pair of long pants that when lower portions of, for example, the pant legs come in contact with and absorb some moisture (e.g., environmental or otherwise), a pattern becomes revealed on the lower portions of the pant legs. When the moisture is no longer in contact with the pair of pants and as it evaporates from the fabric or textile of the lower body garment, the pattern starts to disappear. Thus, aspects herein are directed to a wetness indicator garment useful for providing a visual indication to the wearer, and to others viewing the wearer, that wet conditions may be present. For instance, the wearer may be a golfer who is playing in areas of the golf course having high amounts of dew. The golfer's pants provide a visual indication of the amount or degree of wetness in these areas allowing the golfer, and his fellow golfers, to adjust their play accordingly. Further, in addition to providing the visual indication, the golfer's pants are protected from becoming saturated with moisture, which maintains comfort for the wearer in wet conditions, as will become more apparent in the description below with respect to the figures.

In one aspect, the lower body garment comprises at least one panel of a textile material having a first surface and a second surface, with the first surface being an outer-facing surface (i.e., facing an external environment) and the second surface being an inner-facing surface (i.e., facing a wearer's body). A portion of the first surface of the textile material is treated with a water-repellant coating material such as a durable water repellant (DWR) coating (the terms "water-repellant coating material," "water-repellant coating," "DWR coating," and other similar variations may be used interchangeably herein). The water-repellant coating material is applied to form a pattern with coated portions and non-coated portions. The coated portions comprise a plurality of discrete shapes that are isolated from one another by surrounding interconnected non-coated perimeter portions.

In another aspect, the pattern comprises a plurality of discrete shapes, where a size of the discrete shapes is gradually decreased from a first area of the treated portion to a second area of the treated portion resulting in a size gradient. The first area is located between the bottom edge (e.g., the hem) of the lower body garment and the second area. In other words, the first area is positioned at an inferior aspect of the lower body garment and the second area is positioned superior to the first area. The first area may be configured to cover from about 2 cm to about 20 cm, from about 5 cm to about 20 cm, from about 7 cm to about 15 cm, or from about 2 cm to about 10 cm as measured from the bottom edge of the lower body garment. The second area may be directly adjacent to the first area and may be configured to extend up to from about 10 cm to about 60 cm, from about 15 cm to about 60 cm, from about 20 cm to about 55 cm, from about 10 cm to about 50 cm, or from about 15 cm to about 45 cm, when measured from the bottom edge of the lower body garment. As described herein, the term "about" is used to mean that the measured distance is within ±10% of a designated distance value. In other words, the DWR coating may be applied on to the lower body garment at lower body garment portions that are configured to align with portions of a leg of a wearer that are at, slightly above, or slightly below the knee of the wearer.

The larger shapes of the water-repellant coating may be provided in the first area closer to the bottom edge to provide coverage of a larger surface area than in portions that are further from the bottom edge in order to prevent the pant leg from becoming overly saturated when in direct contact with moisture from, for example, wet grass, a wet floor, rain, and the like. Therefore, the coated portions do not absorb moisture and thus stay essentially dry. However, the non-coated portions surrounding each discrete shape absorb moisture and therefore undergo a color change, becoming darker or deeper in color when compared to portions of the lower body garment that comprise the water-repellant coating. This may be especially apparent when the lower body garment is formed from a fabric that is lighter in color such as, for example, a light tan color, a light blue color, and the like. As such, the pattern of shapes formed by the water-repellant coating on the pant leg becomes visible. As described briefly above, once the moisture evaporates from the non-coated portions, the fabric or textile of the lower body garment dries out, and the pattern of shapes formed by the water-repellant coating material becomes invisible once again.

Another aspect in accordance with aspects herein is related to a method of constructing a wetness indicator lower body garment, the method comprising providing at least one garment panel for constructing the lower body garment. The method further includes applying a coating of a water-repellant material to a first surface of the garment panel starting at a first area of the garment panel, the coating being applied in a pattern comprising a plurality of discrete shapes. Each shape is surrounded by a non-coated portion of the garment panel that does not have the water-repellant coating, wherein a size of the discrete shapes in the plurality of discrete shapes may be the same throughout, or alternatively, the size of the discrete shapes in the plurality of discrete shapes may be gradually decreased from the first area to a second area of the garment panel. Further, the method includes forming the garment panel into a leg portion of the lower body garment, such that the first area corresponds to a cuff or bottom edge area of the leg portion and the second area corresponds generally to a knee area of the leg portion.

Figure 1B:
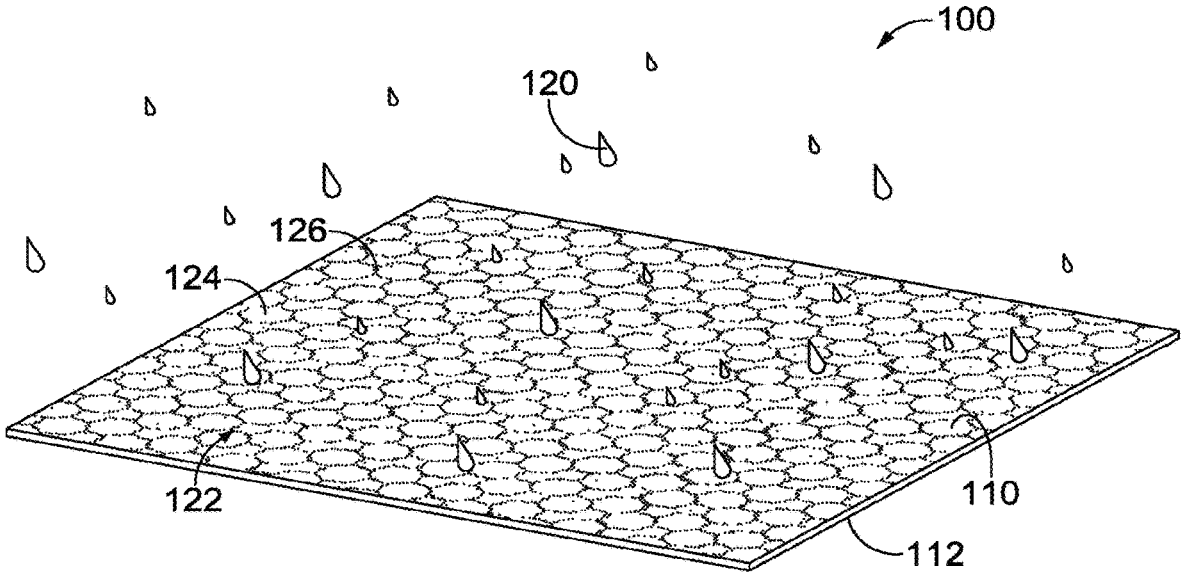
FIG. 1B depicts a fabric or textile panel under wet conditions in accordance with aspects herein.
Figure 1C:
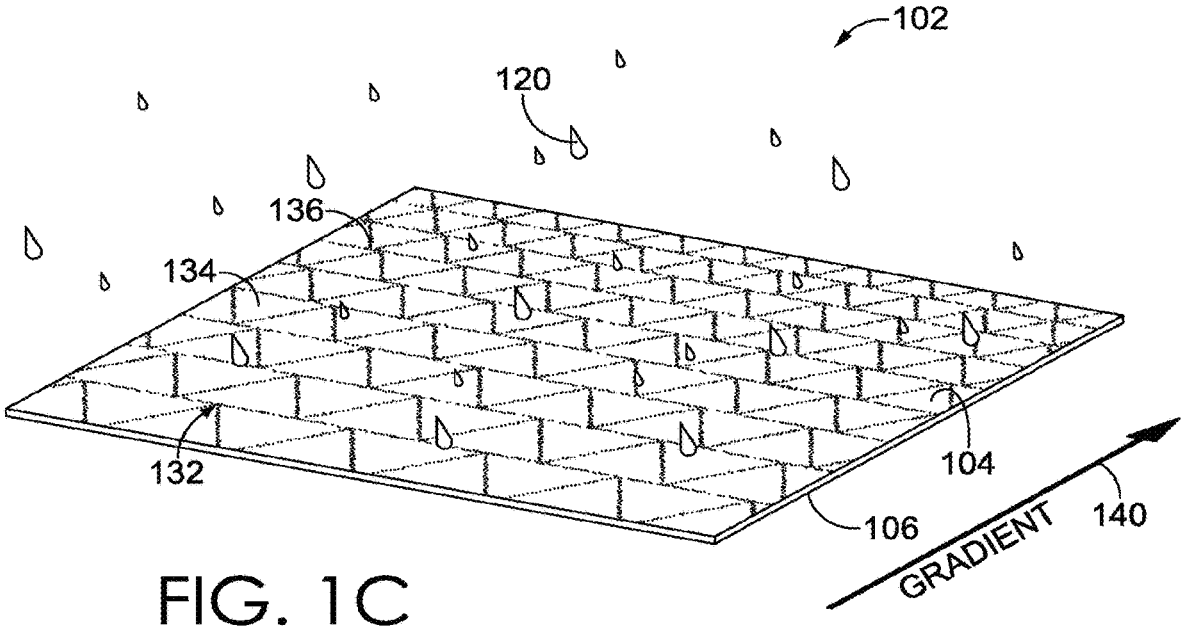
FIG. 1C depicts a different fabric or textile panel under wet conditions in accordance with aspects herein.

With reference to the figures, FIGS. 1A, 1B, and 1C depict an exemplary wetness indicator fabric or textile piece 100 in accordance with aspects herein. More specifically, FIG. 1A depicts the exemplary wetness indicator fabric or textile piece 100 under dry conditions, and FIG. 1B depicts the exemplary wetness indicator fabric or textile piece 100 under wet conditions. The fabric or textile piece 100 may be, for example, a stretch woven fabric, a knit fabric, a woven fabric, and the like. The fabric or textile piece 100 may be formed from polyester yarns, cotton yarns, rayon yarns, silk yarns, hemp yarns, nylon yarns, and the like, or a combination of these. Further, the fabric or textile piece 100 may also comprise interwoven or interknit elastic yarns such as elastane yarns in order to provide stretchability to the fabric or textile for comfort when the fabric or textile is formed into a garment. Furthermore, the fabric or textile may be treated with different coatings to provide additional properties to the fabric or textile such as, for example, moisture management properties. Additionally, the fabric or textile may also include performance yarns such as high tensile strength yarns, aramid yarns, and the like, for reinforcing the fabric or textile.

As shown in FIG. 1A, the exemplary wetness indicator fabric or textile piece 100 comprises a first surface 110 and a second surface 112 opposite the first surface 110, where the first surface 110 comprises a water-repellant coating material applied in a pattern, the pattern not being visible under dry conditions. In other words, under dry conditions, the first surface 110 of the fabric or textile piece 100 may present a first appearance, depending on whether the exemplary wetness indicator fabric or textile piece 100 is comprised of a solid color fabric or textile or a patterned or multicolored fabric or textile.

FIG. 1B depicts the fabric or textile piece 100 under wet conditions, where FIG. 1B depicts a first exemplary pattern of shapes 122 revealed, as shown with reference to FIG. 1C, many different patterns are available for the pattern of shapes, where FIG. 1C depicts a second exemplary pattern of shapes 132 revealed on a wetness indicator fabric or textile piece 102 that when dry, would have a similar or the same appearance as the fabric or textile piece 100 shown in FIG. 1A. With respect to FIG. 1B, in the presence of moisture 120 (e.g., dew, rain, snow, mist, and the like), the pattern of shapes 122 of the water-repellant coating material on the first surface 110 of the exemplary wetness indicator fabric or textile piece 100 becomes revealed. As described briefly above, the pattern of shapes 122 is comprised of a plurality of discrete water-repellant coated portions 124 where each of the discrete water-repellant coated portions 124 comprises a predetermined shape. Each of the discrete water-repellant coated portions 124 is surrounded or circumscribed by a portion of the fabric or textile material that is not coated with the water-repellant coating material. In other words, each of the discrete water-repellant coated portions 124 is surrounded by perimeter portions 126 that are not coated with the water-repellant coating material.

As shown in FIG. 1B, the non-coated perimeter portions 126 are interconnected. To describe it in a different way, the perimeter portions 126 form a continuous path through which moisture may, for example, wick or travel. Therefore, as the exemplary wetness indicator fabric or textile piece 100 is exposed to moisture 120 such as, for example, water from rain, a puddle, a sprinkler, and the like, the wetness indicator fabric or textile piece 100 absorbs the moisture 120 at the perimeter portions 126 and, depending on the amount of moisture absorbed, the fabric or textile piece 100 may undergo a change of color at the perimeter portions 126 to generate a second visual appearance different from the first visual appearance (i.e., when the fabric or textile piece 100 is dry as shown in FIG. 1A.) In the case of fabric or textile materials that are generally light in color, the change in color due to wetness or exposure to moisture 120 is a color darkening effect, and thus, the perimeter portions 126 may become darker than dry portions and the discrete water-repellant coated portions 124 of the wetness indicator fabric or textile piece 100, resulting in the pattern of shapes 122 being revealed (i.e., becoming visible). Then, when the moisture is allowed to evaporate, the pattern of shapes 122 becomes hidden again as the perimeter portions 126 dry and their color is restored to the original color of the wetness indicator fabric or textile piece 100 when in a dry state as shown in FIG. 1A.

It is contemplated that the water-repellant coating material is a type of durable water-repellant coating material generally known as DWR, however, any other type of water-repellant coating material suitable for use in accordance with aspects herein may be used. It is also contemplated that the water-repellant coating material may be applied on to the wetness indicator fabric or textile piece 100 in any desired pattern comprised of any desired shapes having any desired size. It is further contemplated that different sections of the wetness indicator fabric or textile piece 100 in accordance with aspects herein may comprise different patterns.

For example, as shown in FIG. 1B, the pattern of shapes 122 may include discrete water-repellant coated portions 124 and perimeter portions 126 having a uniform shape, a uniform size, and a uniform width throughout the treated portion of the fabric or textile. Alternatively, as shown in FIG. 1C, the fabric or textile piece 102 having a first surface 104 and a second surface 106, may comprise, on the first surface 104, a pattern of shapes 132 that includes water-repellant coated portions 134 that are different sizes while the perimeter portions 136 remain constant throughout. For example, the water-repellant coated portions 134 in FIG. 1C, become gradually smaller in the direction of the gradient 140 (i.e., each of the water-repellant coated portions 134 decrease in surface area in the direction of the gradient 140). In this particular example, since the shapes of the water-repellant coated portions 134 become gradually smaller following the gradient 140, the total surface area covered by the perimeter portions 136 is increased with the gradient 140, thereby allowing the fabric or textile piece 102 to have, for example, greater breathability in the area where the water-repellant coated portions 134 are smaller in size. In yet a different example, as will be discussed in further detail below with reference to FIG. 2, both the shape and size of the water-repellant coated portions, as well as the size (i.e., thickness) of the perimeter portions may be varied throughout.

The pattern formed by the fabric or textile portions that are coated with the water-repellant coating material and the fabric or textile portions that are not coated with the water-repellant coating material enable the wetness indicator fabric or textile piece 100 to provide protection from the elements (i.e., moisture) without sacrificing breathability of the fabric or textile, and signals to the wearer and others in the wearer's vicinity that there is moisture in the environment. For example, when the wetness indicator fabric or textile piece 100 is used to form a lower body garment that is configured to cover the full length of a wearer's legs, and the wearer is walking through wet grass, the garment may signal to the wearer and others in the wearer's vicinity that the grass is wet by absorbing moisture from the grass and revealing the pattern formed by the water-repellant coated and non-coated portions of the wetness indicator fabric or textile piece 100 where moisture has been absorbed.

Figure 2:
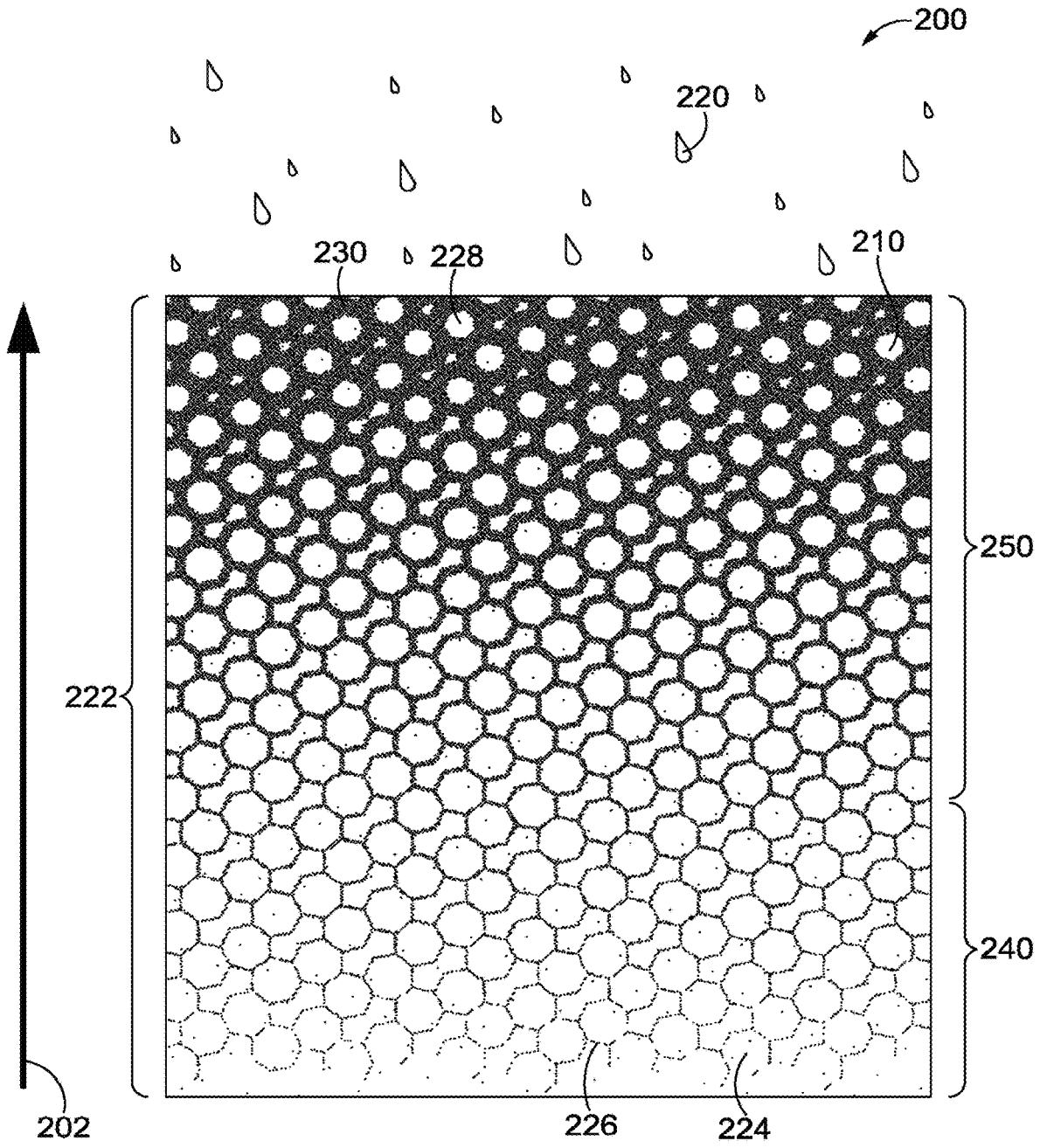
FIG. 2 depicts a different exemplary fabric or textile panel under wet conditions in accordance with aspects herein.

FIG. 2 depicts a fabric or textile piece 200 that comprises a water-repellant coating material applied on to a first surface 210 of the fabric or textile piece 200 in a pattern 222. The pattern 222 is comprised of a plurality of discrete water-repellant coated portions having discrete shapes that are provided in a size gradient 202. In other words, water-repellant coated portions 224 in a first area 240 have a first shape and size, and water-repellant coated portions 228 have a second shape and size in a second area 250. The shape and size of the plurality of discrete water-repellant coated portions 224/228 throughout the fabric or textile piece 200 is gradually decreased according to the direction of the size gradient 202. In other words, the water-repellant coated portions 228 in the second area 250 are smaller in size or have less surface area per each shape than the water-repellant coated portions 224 in the first area 240.

As well, following the size gradient 202, the size or coverage area of the non-coated portions in the fabric or textile piece 200 is inversely proportional to the size or coverage area of the coated portions 224/228. In other words, in one exemplary aspect, as the size and shape of the water-repellant coated portions 224/228 is decreased, the portions of the fabric or textile piece 200 that are not coated with the water-repellant coating material (i.e., the perimeter portions surrounding each coated portion) become gradually larger/thicker, or said differently, non-coated portions 226 surrounding the water-repellant coated portions 224 are smaller/thinner (or occupy less surface area) than non-coated portions 230 surrounding water-repellant coated portions 228.

Continuing, just like in the fabric or textile piece 100 shown in FIG. 1B, the non-coated portions 226, the non-coated portions 230, and all non-coated portions between the non-coated portions 226 and the non-coated portions 230 are interconnected. Thus, even if the moisture 220 is in direct contact with only non-coated portions 226, for example, depending on the absorptivity of the fabric/textile, the moisture 220 will become absorbed and travel by capillary action to the rest of the non-coated portions, such as the non-coated portions 230. The extent of the moisture 220 traveling by capillary action will also depend on the level of saturation of the non-coated portions 226 since, once saturated, further absorption of moisture will be slowed down.

No matter the actual shape(s) chosen for the pattern 222, the size gradient 202 provided is advantageous because it allows the fabric or textile piece 200, for example, to provide greater wetness protection in desired sections of the fabric or textile piece 200, while allowing more breathability in other portions of the fabric or textile piece 200. This is because, in some exemplary aspects, water-repellant coating materials may decrease the breathability of the fabric or textile when compared to the breathability of the fabric or textile in its original state without any coatings on it.

Returning briefly to FIG. 1C, another way to achieve similar results is by varying the size of the coated portions (e.g., water-repellant coated portions 134) without varying the thickness of the non-coated portions (e.g., perimeter portions 136). Although the thickness of the non-coated portions (e.g., perimeter portions 136) is the same throughout the pattern, the effective total surface area covered by the non-coated portions (e.g., perimeter portions 136) is increased when the size of the shapes of the water-repellant coated portions 134 is decreased because there are more perimeters portions 136 circumscribing smaller shapes of water-repellant coated portions 134 within a given surface area. Thus, providing a pattern of water-repellant coated portions 134 with shapes that are gradually reduced in size or surface area according to a gradient (e.g. gradient 140), or simply reduced in size or surface area when transitioning from one area to another area of the garment, or fabric or textile piece, protection against wetness and breathability of the fabric or textile material is not compromised. Although not shown, it is also contemplated that the pattern in which the water-repellant coating material is applied may be comprised of more than one shape and the shapes may be geometrical, organic, letters, images, logos, and the like.

Returning to FIG. 2, as described above with respect to the fabric or textile piece 100 in FIGS. 1A-1C, when the fabric or textile piece 100 is exposed to moisture 120, the non-coated portions 126/136 absorb the moisture 120 and reveal the pattern 122/132. Similarly, when the fabric or textile piece 200 is exposed to moisture 220, the non-coated portions, e.g., 226 and 230 absorb the moisture 220 and become darker in color, revealing the pattern 222.

Figure 3A:
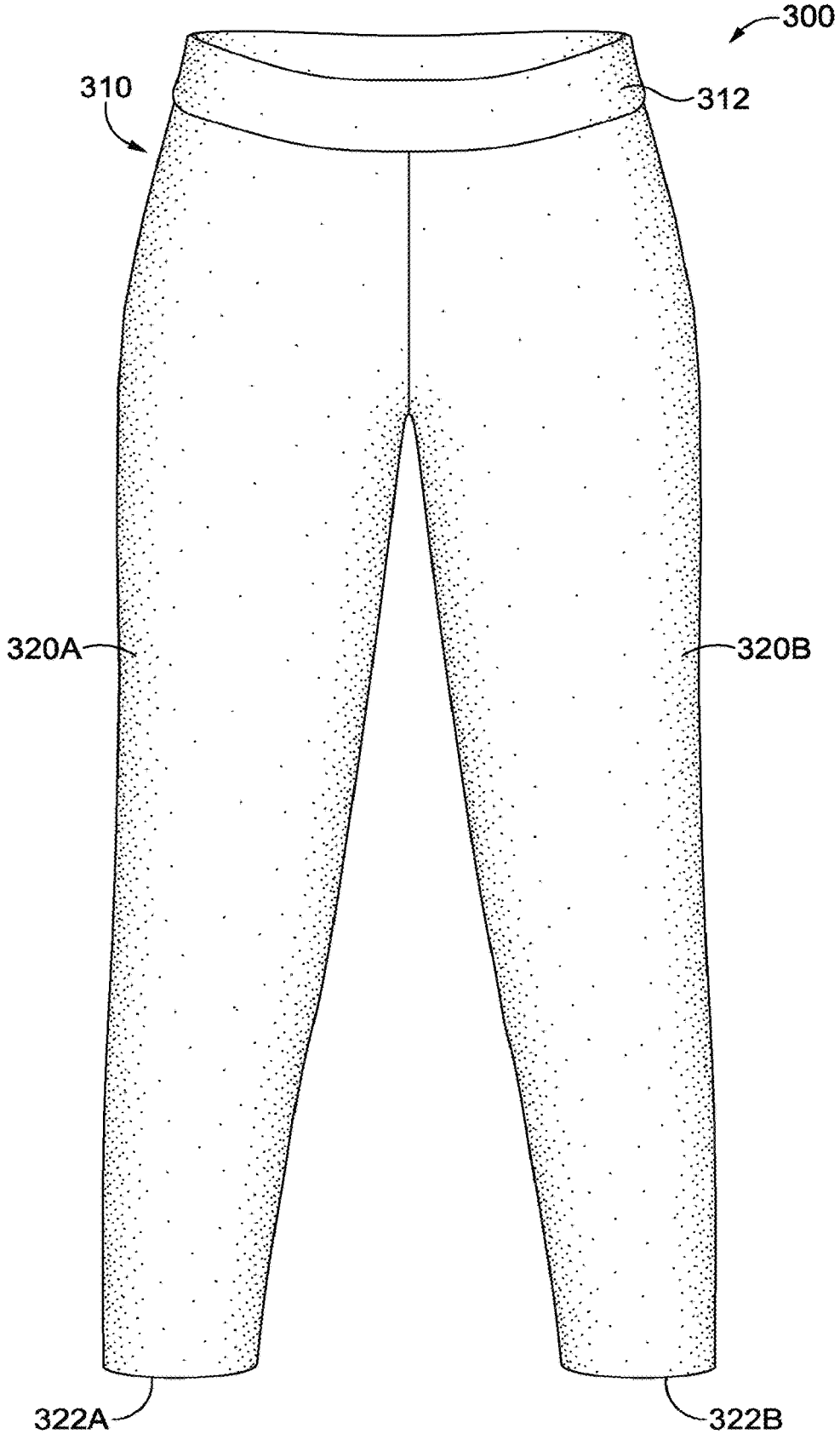
FIG. 3A depicts an exemplary lower body garment under dry conditions in accordance with aspects herein.
Figure 3B:
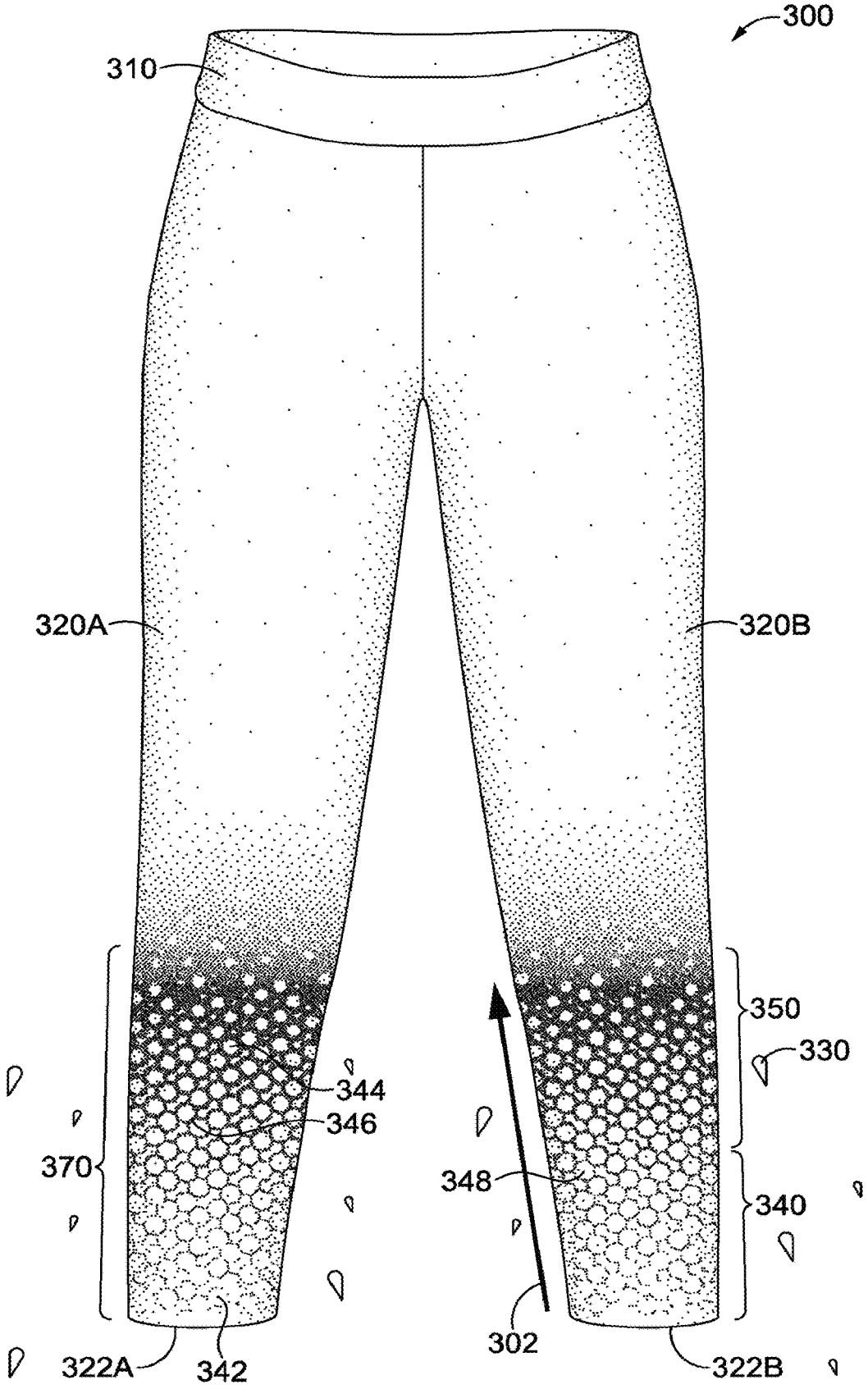
FIG. 3B depicts the exemplary lower body garment of FIG. 3A under wet conditions in accordance with aspects herein.

Moving on to FIGS. 3A and 3B, an exemplary lower body garment 300 comprising a wetness indicator fabric or textile in accordance with aspects herein, is shown. The exemplary lower body garment 300 is shown as a pair of long pants or trousers comprising at least a torso component 310 that optionally includes a waistband 312, a first pant leg 320A and a second pant leg 320B. FIG. 3A shows the exemplary lower body garment 300 in a dry state, and FIG. 3B shows the exemplary lower body garment 300 in a wet state. As shown in FIG. 3A, the pattern 370 of the water-repellant coating material is not visible when dry, and as shown in FIG. 3B, the pattern 370 of the water-repellant coating material becomes visible when water 330 comes into contact with the water-repellant coated portions of the pant legs 320A and 320B. As described above, it is desirable to provide the water-repellant coating material to areas of a garment that would be more prone to being exposed to moisture rather than providing the water-repellant coating material to the whole garment because the water-repellant coating material may decrease the breathability of the fabric or textile material of the garment. By providing the water-repellant coating material only to the areas that would be most likely exposed to the environmental moisture, the garments in accordance with aspects herein provide wetness protection without sacrificing breathability, which if compromised, may cause discomfort.

As better seen in FIG. 3B, the water-repellant coated portions of the exemplary lower body garment 300 are limited to lower portions of the respective pant legs 320A and 320B and may extend up to portions of the pant legs 320A and 320B that are generally configured to align with a portion of the wearer's legs that are slightly below or slightly above the wearer's knees. As shown, in order to provide the greatest amount of protection where needed (i.e., closer to a bottom edge of each pant leg where hemming is usually provided), a water-repellant coating material may be provided as a plurality of discrete shapes 348, where a size of the discrete shapes 348 may be gradually decreased from a first area 340 of the treated portions to a second area 350 of the treated portions, resulting in a size gradient for the plurality of discrete shapes 348. The first area 340 may be configured to cover between 2 cm and 20 cm, between 5 cm and 20 cm, between 7 cm and 15 cm, or between 2 cm and 10 cm measured from the bottom edges 322A and 322B of the lower body garment 300. The second area 350 may be directly adjacent to the first area 340 and may be configured to extend up to between 10 cm and 60 cm, 15 cm and 60 cm, 20 cm and 55 cm, 10 cm and 50 cm, or 15 cm and 45 cm, when measured from the bottom edges 322A and 322B of the lower body garment 300.

In the lower body garment 300 shown in FIG. 3B, the pattern 370 of discrete shapes 348 of the applied water-repellant coated material is provided according to a gradient 302 where the coated sections comprise a larger plurality of discrete shapes 342 in the first area 340 and a gradually smaller plurality of discrete shapes 344 in the second area 350. The larger plurality of discrete shapes 342 are provided closer to the bottom edges 322A and 322B. The location of the larger plurality of discrete shapes 342 is advantageous since, for example, if the user were to be walking in wet grass, the water-repellant coating material covering a majority of the surface area of the first area 340 would mostly prevent the water 330 from penetrating through the thickness of the material forming the pant legs 320A and 320B and therefore, prevent or reduce the chances of the legs of the wearer from becoming wet. However, as described above with respect to FIG. 2, when the plurality of shapes of the water-repellant coating material become progressively smaller, as in the second area 350, the exposed or non-coated portions 346 may become progressively wider, as shown in FIG. 3B, or the total surface area of the non-coated portions 346 may be increased as in the example shown in FIG. 1C, even with the width of the non-coated portions 346 staying constant. As shown in the exemplary lower body garment 300 in FIG. 3B, the higher up the pant legs 320A and 320B, the plurality of discrete shapes 348 may become progressively smaller and smaller and more scattered. This scattering is advantageous because as the plurality of discrete shapes 348 become progressively smaller and scattered, the surface area of the non-coated portions 346 is increased at a faster rate. Therefore, the lower body garment 300, for example, may provides protection from wetness where needed, without interfering with the breathability of the garment since the water-repellant coating occupies a progressively smaller surface area as the pant legs 320A and 320B extend toward the torso component 310. In addition to providing the advantages of protection from moisture, the pattern 370 of the water-repellant coating material may give the lower body garment 300 greater visual appeal.

Figure 4:
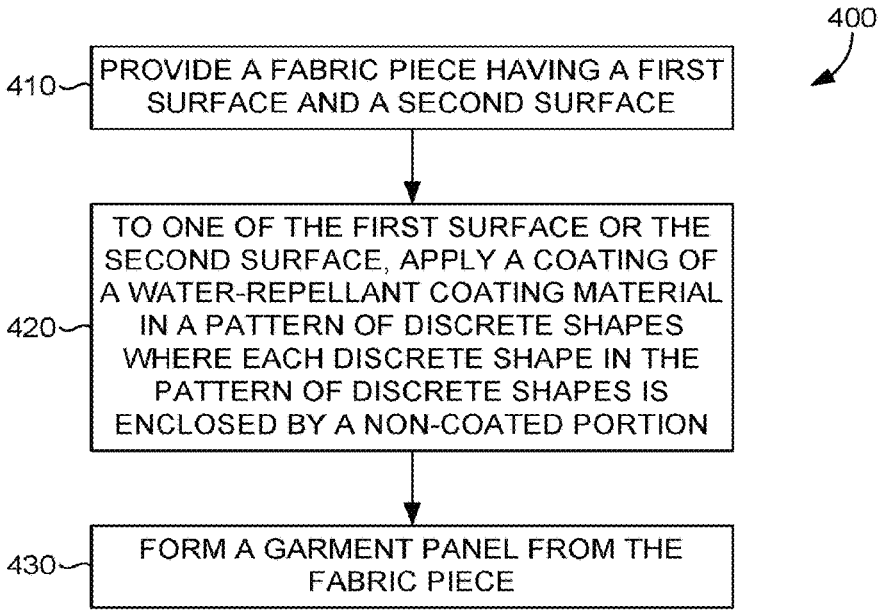
FIG. 4 depicts an exemplary method for forming a garment panel in accordance with aspects herein.

Additional aspects in accordance with the technology described herein are related to a method of manufacturing a wetness indicator fabric/textile material for forming a wetness indicator lower body garment such as, for example, the wetness indicator lower body garment 300 in FIGS. 3A and 3B. FIG. 4, for example, outlines a method 400 for manufacturing a wetness indicator fabric/textile that includes the steps of, for example, providing a fabric or textile piece having a first surface and a second surface opposite the first surface. As shown at step 410, a coating of a water-repellant coating material is applied on to just one of the first surface or the second surface in a pattern of discrete shapes where each discrete shape is enclosed or circumscribed by a non-coated portion as shown at step 420. At step 430, a garment panel is formed from the fabric or textile piece. It should be noted that steps 420 and 430 may be interchangeable, as the water-repellant coating material may be applied after the garment panel is formed by, for example, laser cutting, die cutting, scissor cutting, and the like from a fabric or textile piece. Then, when the garment panel is used to construct a garment, the surface comprising the water-repellant coating material (e.g., the first surface or the second surface) is used as the external surface of the garment configured to face away from an interior cavity of the garment. As well, the water-repellant coating material may be applied on to a garment after the garment has been fully constructed, and is still within the scope of aspects disclosed herein.

Figure 5:
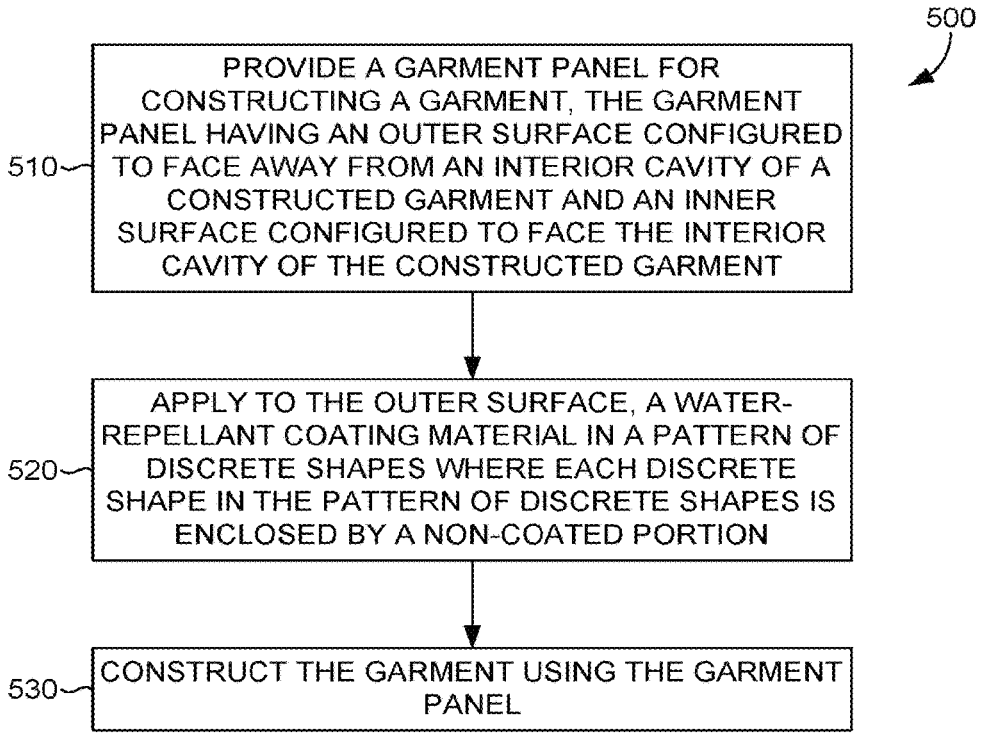
FIG. 5 depicts an exemplary method for constructing a wetness indicator garment in accordance with aspects herein.

FIG. 5 outlines a method 500 for constructing a garment that is in accordance with aspects herein. The method comprises the steps of providing a garment panel for constructing a garment, the garment panel having an outer surface configured to face away from an interior cavity of a constructed garment and an inner surface configured to face the interior cavity of the constructed garment, as shown at step 510. Further, the method comprises applying to just the outer surface of the garment panel, a water-repellant coating material in a pattern of discrete shapes where each discrete shape in the pattern of discrete shapes is enclosed by a non-coated portion, as shown at step 520. In other words, the interior surface does not comprise the water-repellant coating material. The garment is constructed using the garment panel, as shown at step 530. However, as described above, the coating step may be performed prior to step 510 or after step 530 without departing from aspects herein.

In other words, in accordance with aspects herein, the water-repellant coating material is applied on to the surface that is to be used as the external surface, and is not applied on to the internal surface facing a wearer when a garment formed from the fabric or textile in accordance with aspects herein, is worn by the wearer. The internal surface may in some cases, be in direct contact with the wearer's skin therefore, not having the water-repellant coating material on the internal surface is advantageous because moisture that may be generated internally from for example, sweat from the wearer, is allowed to be wicked away from the body of the wearer. If the water-repellant material were to be applied on to both surfaces, the moisture wicking properties of the fabric or textile may become negatively affected. Thus, the fabric or textile in accordance with aspects herein comprises both moisture wicking properties on one surface and water-repellant properties on the opposite surface. As such with a garment constructed with the fabric or textile in accordance with aspects herein, a wearer's comfort is enhanced because moisture from, for example sweat, may be wicked away from the wearer, while environmental moisture may be prevented from penetrating the fabric or textile, at least at the water-repellant coated portions of the garment, when the garment is worn by the wearer.

Other treatments that may be applied on to the fabric or textile prior to applying the water-repellant coating material may include, for example, treating the fabric or textile with a wicking finishing coat on the inner surface to give the fabric or textile moisture management properties that help move moisture from, for example sweat, away from the wearer and into the environment by evaporation. The moisture transport may be done by, for example, denier differential mechanisms, capillary action, a hydrophilic gradient, and the like. As well, the constructed garment may be subjected to a silicone wash, at least in the portions of the garment where the water-repellant coating material is applied. The silicone wash may further improve the water-repellant coating material's properties by, for example, preventing wicking of external moisture from the outer surface to the inner surface of the fabric or textile.

Although the technology described herein is shown as being in the form of long pants or trousers, it is also contemplated that the technology described herein may be provided in upper body garments, body suits, or even other types of lower body garments such as, for example, a long skirt. In the case of upper body garments, the technology described herein may, for example, be provided at a hood portion, a shoulder portion, and the like, which would most likely be the most exposed, for example, in the case of rainy or snowy weather. As well, the technology described herein may also be applied to articles such as umbrellas, tents, bags, and the like.

It will be understood that certain features and subcombinations are of utility and may be employed without reference to other features and subcombinations. This is contemplated by and is within the scope of the claims.

Since many possible embodiments may be made of the technology described herein without departing from the scope thereof, it is to be understood that all matter herein set forth or shown in the accompanying drawings is to be interpreted as illustrative and not in a limiting sense.

The invention claimed is:

1. A textile material comprising:

a first surface and a second surface; and a pattern of a water-repellant coating applied on to the first surface, the pattern comprising a plurality of discrete shapes, wherein each discrete shape in the plurality of discrete shapes is surrounded by one or more portions of the textile material that do not have the water-repellant coating applied on to the first surface, wherein a size of the plurality of discrete shapes gradually decreases from a first area of the textile material toward a second area of the textile material, wherein the each discrete shape in the plurality of discrete shapes is isolated from another shape in the plurality of discrete shapes; and wherein the one or more portions of the textile material that surround the each discrete shape in the plurality of discrete shapes are interconnected and have a constant width throughout.

2. The textile material of claim 1, wherein the pattern of the water-repellant coating is visible under wet conditions.

3. The textile material of claim 1, wherein the textile material is comprised of a woven fabric material.

4. The textile material of claim 3, wherein the woven fabric material comprises moisture management properties.

5. The textile material of claim 1, wherein the second area is directly adjacent to the first area.

6. The textile material of claim 1, wherein a first surface area covered by the water-repellant coating is greater in the first area than a second surface area covered by the water-repellant coating in the second area.

7. The textile material of claim 1, wherein the textile material is comprised of polyester yarns.

8. A method of making a wetness indicator textile material, the method comprising:

applying a coating of a water-repellant material to a first surface of the wetness indicator textile material, wherein the coating is applied in a pattern comprising a plurality of discrete shapes, wherein each shape in the plurality of discrete shapes is surrounded by one or more portions of the wetness indicator textile material that do not have the coating of the water-repellant material applied to the first surface, wherein a size of each discrete shape in the plurality of discrete shapes gradually decreases from a first area to a second area of the wetness indicator textile material, wherein the each shape in the plurality of discrete shapes is isolated from another shape in the plurality of discrete shapes; and wherein the one or more portions of the wetness indicator textile material that surround the each discrete shape in the plurality of discrete shapes are interconnected and have a constant width throughout.

9. The method of claim 8, wherein a first surface area covered by the water-repellant material is greater in the first area than a second surface area covered by the water-repellant material in the second area.

10. The method of claim 8, wherein the wetness indicator textile material is used for forming a lower body garment, wherein in the lower body garment, the first surface is an outer-facing surface configured to be exposed to environmental elements when the lower body garment is worn by a wearer.

11. The method of claim 8, wherein the wetness indicator textile material is comprised of a woven textile material.

12. The method of claim 11, wherein the woven textile material is comprised of polyester yarns.

13. The method of claim 8, wherein the pattern of the water-repellant material is visible during wet conditions and not visible during dry conditions.

14. A garment formed from the wetness indicator textile material formed according to the method of claim 9.

15. The garment of claim 14, wherein the garment is one of an upper body garment or a lower body garment.

16. The garment of claim 15, wherein when the garment is the upper body garment, the pattern comprising the plurality of discrete shapes is provided at a shoulder portion of the upper body garment.

17. The garment of claim 16, wherein the upper body garment further comprises a hood portion with the pattern comprising the plurality of discrete shapes.

18. The garment of claim 15, wherein when the garment is the lower body garment, the pattern comprising the plurality of discrete shapes is provided such that the first area aligns with a cuff or bottom edge of a leg portion of the lower body garment, and the second area aligns with a knee area of the leg portion.

19. The garment of claim 18, wherein the first area is configured to cover an area of the leg portion of the lower body garment measuring between 2 cm and 20 cm in length when measured from the bottom edge toward the knee area of the leg portion of the lower body garment.

* * * * *